US010450708B2

(12) United States Patent
Vanderford et al.

(10) Patent No.: US 10,450,708 B2
(45) **Date of Patent: *Oct. 22, 2019**

(54) TRENCH FILLING MACHINE

(71) Applicant: The Charles Machine Works, Inc., Perry, OK (US)

(72) Inventors: Cornelius Vanderford, Dunedin, FL (US); Cody L. Sewell, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 247 days.

This patent is subject to a terminal disclaimer.

(21) Appl. No.: 15/455,953

(22) Filed: Mar. 10, 2017

(65) Prior Publication Data

US 2017/0183844 A1 Jun. 29, 2017

Related U.S. Application Data

(63) Continuation-in-part of application No. 13/540,236, filed on Jul. 2, 2012.
(Continued)

(51) Int. Cl.
*E01C 19/47* (2006.01)
*E02F 5/22* (2006.01)
(Continued)

(52) U.S. Cl.
CPC ..... *E01C 19/47* (2013.01); *B66F 9/00* (2013.01); *B66F 9/06* (2013.01); *E01C 19/002* (2013.01); *E01C 19/266* (2013.01); *E02F 5/223* (2013.01); *E01C 2301/40* (2013.01); *E02D 2300/0018* (2013.01)

(58) Field of Classification Search
CPC ..... E01C 19/47; E01C 19/002; E01C 19/266; E01C 2301/40; B66F 9/00; E02F 5/223; E02F 5/103; E02F 5/12; E02D 2300/0018
See application file for complete search history.

(56) References Cited

U.S. PATENT DOCUMENTS 2,089,094 A 8/1937 Kime
3,181,258 A * 5/1965 Duncan ..... E02F 3/783 172/33

(Continued)

FOREIGN PATENT DOCUMENTS

GB 1380398 A 1/1975

OTHER PUBLICATIONS

European Patent Office, "Supplementary European Search Report", dated Jul. 10, 2015, 2 pages, Munich.

(Continued)

*Primary Examiner* — Jamie L McGowan
(74) *Attorney, Agent, or Firm* — Tomlinson McKinstry, P.C.

(57) ABSTRACT

A machine for filling a trench. The machine comprises a tub, release assembly, and a hopper. The tub mixes a material to be filled into the trench. The release assembly releases the material into the hopper and the material flows from the hopper and into the trench. The machine moves parallel to the trench as the trench is being filled. A compactor assembly may follow behind the hopper and pack material into the trench. An operator controls the movement of the machine from an operator station on the machine.

20 Claims, 9 Drawing Sheets

Related U.S. Application Data

(60) Provisional application No. 62/306,284, filed on Mar. 10, 2016, provisional application No. 61/537,790, filed on Sep. 22, 2011.

(51) Int. Cl.

| | |
|---|---|
| ***B66F 9/00*** | (2006.01) |
| ***E01C 19/00*** | (2006.01) |
| ***E01C 19/26*** | (2006.01) |
| ***B66F 9/06*** | (2006.01) |

(56) References Cited

U.S. PATENT DOCUMENTS 3,402,816 A 9/1968 Taylor
3,439,806 A 4/1969 Kass et al.
3,849,017 A 11/1974 Rochfort
3,877,830 A 4/1975 James
3,898,940 A * 8/1975 Ede ..... E02B 11/00 111/154
4,071,226 A 1/1978 Miller
4,319,859 A 3/1982 Wise
4,377,365 A 3/1983 Layh
4,383,651 A 5/1983 Couperus
4,496,265 A 1/1985 Fragale
4,507,012 A 3/1985 Corcoran et al.
4,695,186 A 9/1987 King
4,790,687 A * 12/1988 Wright ..... E02D 3/046 37/367
4,806,043 A 2/1989 Fournier
4,830,533 A 5/1989 Miller
4,831,958 A 5/1989 Selby
4,914,840 A 4/1990 Porter
5,120,217 A 6/1992 O'Brien et al.
5,158,394 A 10/1992 Bresnahan
RE34,289 E 6/1993 McClain et al.
5,297,497 A 3/1994 Schmidt
5,427,470 A 6/1995 McKim
5,431,233 A 7/1995 Schmidt
5,573,347 A 11/1996 Miles
5,765,966 A * 6/1998 White ..... E02F 5/103 404/108
5,846,022 A 12/1998 Grundl
5,848,871 A 12/1998 Thiessen
5,864,971 A 2/1999 Jones
5,873,396 A 2/1999 Biebrach
5,988,935 A 11/1999 Dillingham
6,012,870 A 1/2000 Dillingham
6,050,744 A 4/2000 Binning
6,055,750 A 5/2000 Yoder
6,089,785 A * 7/2000 Bergman ..... E01C 23/06 404/101
6,213,680 B1 4/2001 Schaeffer et al.
6,273,637 B1 * 8/2001 Peterson ..... E02D 3/032 37/142.5
6,283,697 B1 9/2001 Pierce et al.
6,345,931 B1 2/2002 Capece
6,439,806 B1 8/2002 Dillingham
6,508,606 B1 1/2003 James
6,558,079 B1 5/2003 Kozak et al.
6,612,774 B1 * 9/2003 Dulin ..... E01C 19/266 404/104
6,763,925 B2 7/2004 Woods
6,830,412 B2 12/2004 Perez
6,966,725 B2 11/2005 Cochran
7,255,512 B2 8/2007 Wallace
7,377,719 B1 5/2008 Elizondo et al.
7,441,987 B1 10/2008 Sampey
7,488,149 B2 2/2009 Waldner
7,510,365 B2 3/2009 Babiarz
7,581,339 B2 9/2009 Mizoroke et al.
7,716,773 B1 5/2010 Pahl
7,784,996 B1 8/2010 Cummer
7,886,463 B2 2/2011 Greenberg et al.
7,959,697 B2 6/2011 Francis
8,016,516 B2 9/2011 Johnson et al.
8,128,105 B2 * 3/2012 Filiatrault ..... B62B 5/0083 280/47.131
8,272,493 B1 9/2012 Grengs
8,308,394 B2 11/2012 Whitley
8,465,225 B2 6/2013 Groulx et al.
8,562,249 B2 10/2013 Owegeser
8,573,886 B1 11/2013 Taylor
8,888,403 B2 11/2014 Atherton
9,102,460 B2 8/2015 Pylinski
9,283,825 B2 3/2016 Mousa
9,816,236 B2 * 11/2017 Loomis ..... E01C 23/0973
2002/0044830 A1 * 4/2002 Munie ..... E02F 5/223 404/84.2
2002/0060125 A1 5/2002 Woods
2003/0215288 A1 11/2003 Causie et al.
2009/0035110 A1 2/2009 Woods
2010/0322710 A1 * 12/2010 Ryan ..... E01C 23/06 404/78
2014/0105683 A1 4/2014 McKinnon
2014/0377022 A1 12/2014 Seever

OTHER PUBLICATIONS

International Searching Authority, "Patent Corporation Treaty PCT Search Report", dated Jan. 29, 2013, 3 pages, Korea.
United States Patent and Trademark Office, "Office Action Summary", dated Nov. 20, 2014, U.S. Appl. No. 13/540,236, 10 pages, Alexandria, VA.
United States Patent and Trademark Office, "Office Action Summary", dated May 4, 2015, U.S. Appl. No. 13/540,236, 9 pages, Alexandria, VA.
United States Patent and Trademark Office, "Office Action Summary", dated Oct. 16, 2015, U.S. Appl. No. 13/540,236, 12 pages, Alexandria, VA.
United States Patent and Trademark Office, "Office Action Summary", dated Sep. 6, 2016, U.S. Appl. No. 13/540,236, 13 pages, Alexandria, VA.

* cited by examiner

TRENCH FILLING MACHINE

CROSS REFERENCE TO RELATED APPLICATION

This application claims the benefit of U.S. Provisional Application Ser. No. 62/306,284, filed on Mar. 10, 2016, and is also a continuation-in-part of U.S. application Ser. No. 13/540,236, filed on Jul. 2, 2012, which claims the benefit of U.S. Provisional Patent Application Ser. No. 61/537,790 filed on Sep. 22, 2011, the entire contents of which are incorporated herein by reference.

FIELD OF THE INVENTION

The present invention relates generally to the field of filling a trench, and in particular to trench filling machines for micro-trenches.

SUMMARY OF THE INVENTION

The present invention is directed to a trench filling machine. The trench filling machine comprises a frame, a plurality of ground-contacting motive elements for moving the frame on a ground surface, a mixing vessel supported by the frame, and a hopper supported by the frame and having a discharge conduit. The trench filling machine further comprises a compactor assembly attached to the hopper, a release assembly configured to move material from the mixing vessel to the hopper, and a positioning system configured to selectively move the discharge conduit above and below the ground surface.

DESCRIPTION OF THE PREFERRED EMBODIMENT

Figure 1:
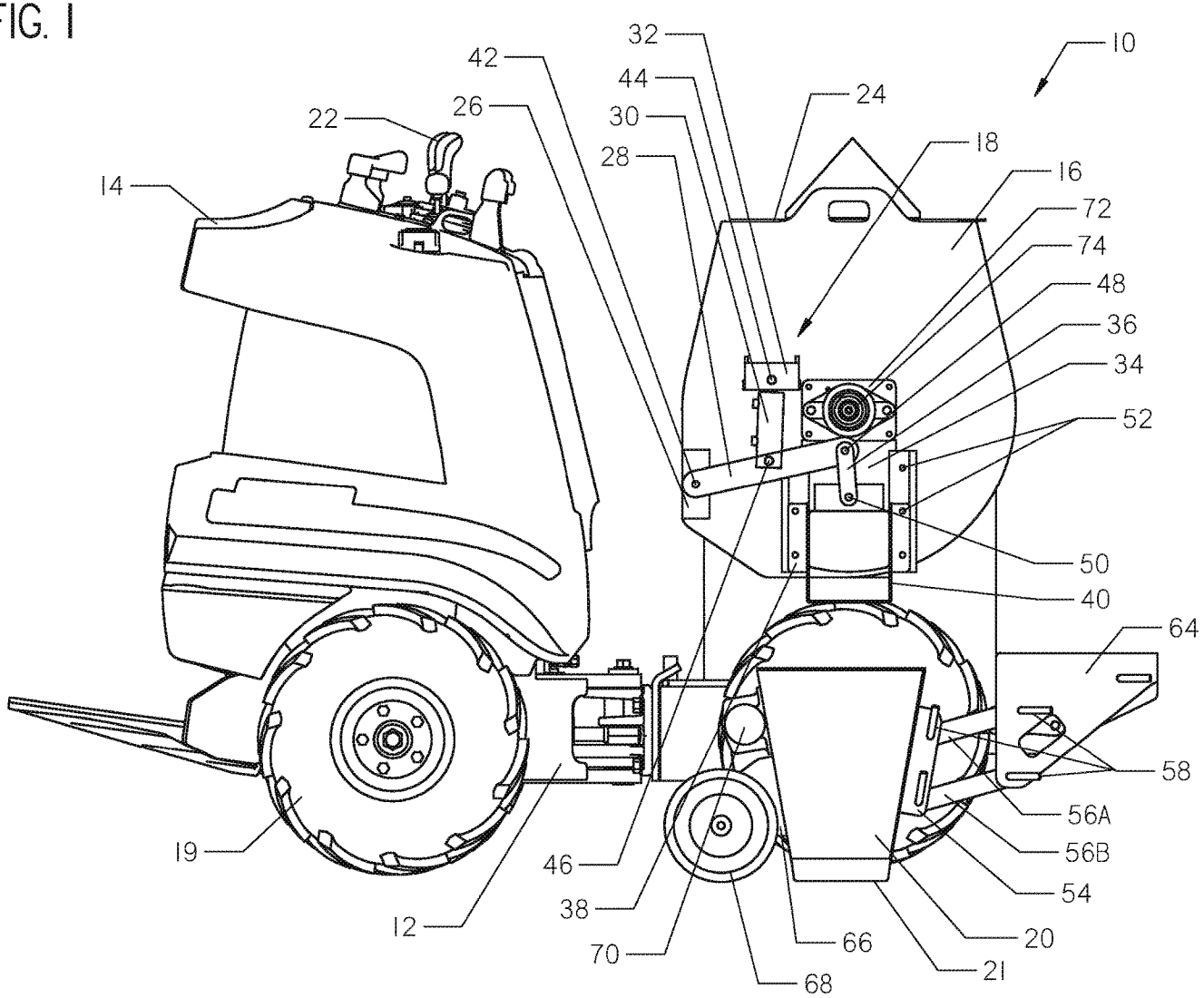
FIG. 1 is a side view of the trench filling machine of the present invention.

Traditionally micro-trenches are filled with grout or any other needed material by hand. The current invention allows the micro-trench to be filled using a machine that moves parallel to the trench as the trench is filled. Turning now to the drawings in general and FIG. 1 specifically, shown therein is a side view of the trench filling machine of the present invention. The trench filling machine designated generally by reference numeral 10 generally comprises a frame 12, an operator station 14, a tub 16, a release assembly

18, and a hopper 20. The trench filling machine 10 is operated and monitored with controls 22 located at the operator station 14. The frame 12 comprises a motive means 19 that works to transport the machine 10 to a desired location and move the machine 10 in line with the trench to be filled. The motive means 19 may comprise wheels or tracks.

The release assembly 18 is positioned on the first side 24 of the tub 16. The release assembly 18 works to release a material from the tub 16 and into the hopper 20. The material may comprise any material necessary to fill the trench. Preferably the material comprises a grout mixture. The release assembly 18 comprises a gate plate 26, a horizontal link 28, a cylinder 30, a cylinder mount 32, a door 34, a vertical link 36, a pair of door guides 38, and a spout 40. The gate plate 26 is attached to the first side 24 of the tub 16. The gate plate 26 serves as an anchor for the horizontal link 28 which is pivotally connected at its end to the gate plate 26 at pivot point 42.

The center of the horizontal link 28 is pivotally connected to cylinder 30 via a fastener 46. Cylinder 30 is in turn connected to cylinder mount 32. The cylinder mount 32 is attached to the first side 24 of the tub 16. The cylinder mount 32 serves as an anchor for the cylinder 30 and a piston (not shown) contained within the cylinder 30. The piston within the cylinder 30 connects to the cylinder mount 32 via a fastener 44. The cylinder 30 and corresponding piston function to move the horizontal link 28 up and down via extension and retraction of the piston in and out of the cylinder 30.

The opposing end of the horizontal link 28 not connected to the gate plate 26 is pivotally connected to vertical link 36 via a fastener 48. The movement of the horizontal link 28 up and down by cylinder 30 and the piston serves to move the door 34 and vertical link 36 up and down opening and closing door 34. The vertical link 36 is connected to the door 34 by a fastener 50. The vertical link 34 aids in opening and closing of door 34.

The movement of the door 34 up and down is stabilized by guides 38. The guides 38 attach to the first side 24 of the tub 16 via a plurality of fasteners 52. The guides 38 serve as a docking slip for the door 34 to slide up and down. The spout 40 is connected to the guides 38 using fasteners 52. The spout 40 extends out from the first side 24 of the tub 16 and over the hopper 20 forming a slide allowing the material to run out of the tub 16, down the spout 40, and into the hopper 20.

Continuing with FIG. 1, the hopper 20 is generally funnel shaped having an upper open end for receiving the material from the tub 16. The lower end of the hopper 20 includes a discharge conduit 21 which is joined to the upper main body portion of the hopper 20 at a relatively downward and forwardly directed angle. This allows the discharge conduit 21 of the hopper 20 to be inserted into the trench to be filled.

The hopper 20 is attached to the front portion of the frame 12 via a pivot plate 54 and lift arms 56A and 56B. The pivot plate 54 is attached to the front side of the hopper 20 and connects the lift arms 56A and 56B to the pivot plate via a pair of fasteners 58. The lift arms 56 work to move the hopper 20 in and out of the trench. Movement of the lift arms 56 is controlled by a hydraulic cylinder 60 (FIG. 3) and a lever 62 (FIG. 3) located behind the side plate 64 shown in FIG. 1.

On the opposite side of the hopper 20 from the pivot plate 54, a wheel mount 66 is attached to the hopper 20. A small wheel 68 is attached to the wheel mount 66 to help guide the hopper 20 along the trench when the hopper 20 is in its lowered position. The wheel 68 runs directly parallel with the open trench when the machine 10 is in operation.

The vibrator 70 is used to vibrate the entire hopper 20 to prevent material from being clogged in the discharge conduit 21 while a trench is being filled. The vibrator 70 may be attached to the side of the hopper 20 just above the wheel mount 66. The vibrator 70 also works to increase the rate of flow of the material through the discharge conduit 21 and into the open trench.

A mount plate 72 is also shown in FIG. 1 attached to the first side 24 of the tub 16 just above the guides 38. The mount plate 72 supports a bearing 74 which is used to support and allow rotation of the shaft 90 (FIG. 4) within the tub 16.

Figure 2:
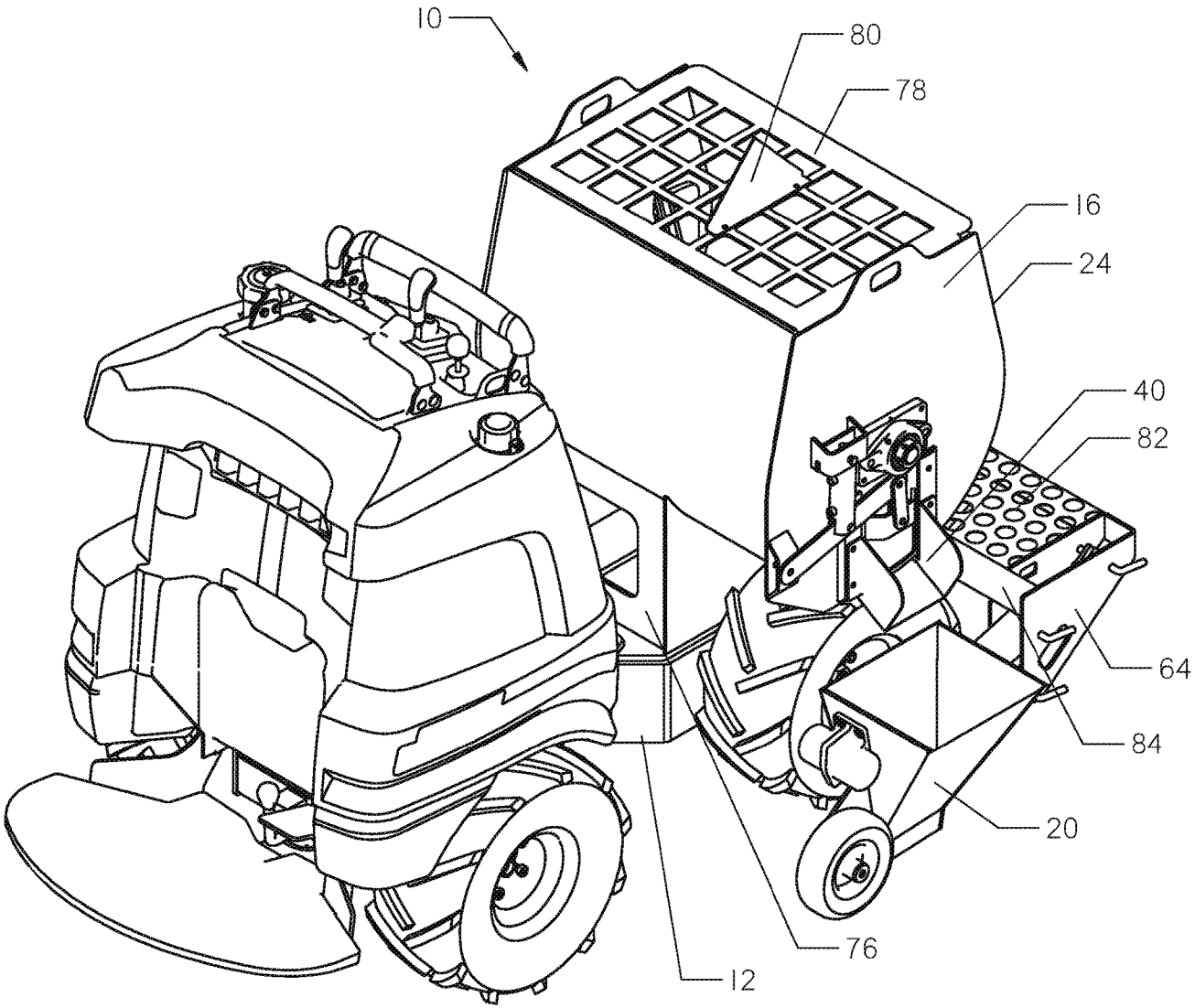
FIG. 2 is a perspective back view of the trench filling machine of FIG. 1.

Turning now to FIG. 2, a perspective back view of the trench filling machine 10 is shown. The tub 16 is supported and stabilized on the frame 12 via a brace 76. The brace 76 is contoured to allow the round bottom portion of the tub 16 to sit within it. The sides of the brace 76 are then attached to the sides of the tub 16 and the base of the brace 76 is attached to the motorized frame stabilizing the tub 16 while the machine 10 is in operation.

The top of the tub 16 is covered by a grate 78 which allows access to the inside of the tub 16 while at the same time protecting the material from debris. A bag cutter 80 is mounted on the top of the grate 78 for convenience in opening bags of material to pour into the tub 16.

A platform 82 is also shown attached to the front of the frame 12. The platform 82 aids in preparing and attending to the contents of the tub 16. A tube 84 is attached to the platform 82 and the side plate 64 to support the frame 12 and platform 82. A different view of the spout 40 is also shown in FIG. 2 depicting more clearly how the spout functions as a slide to move the material from the tub 16 to the hopper 20.

Figure 3:
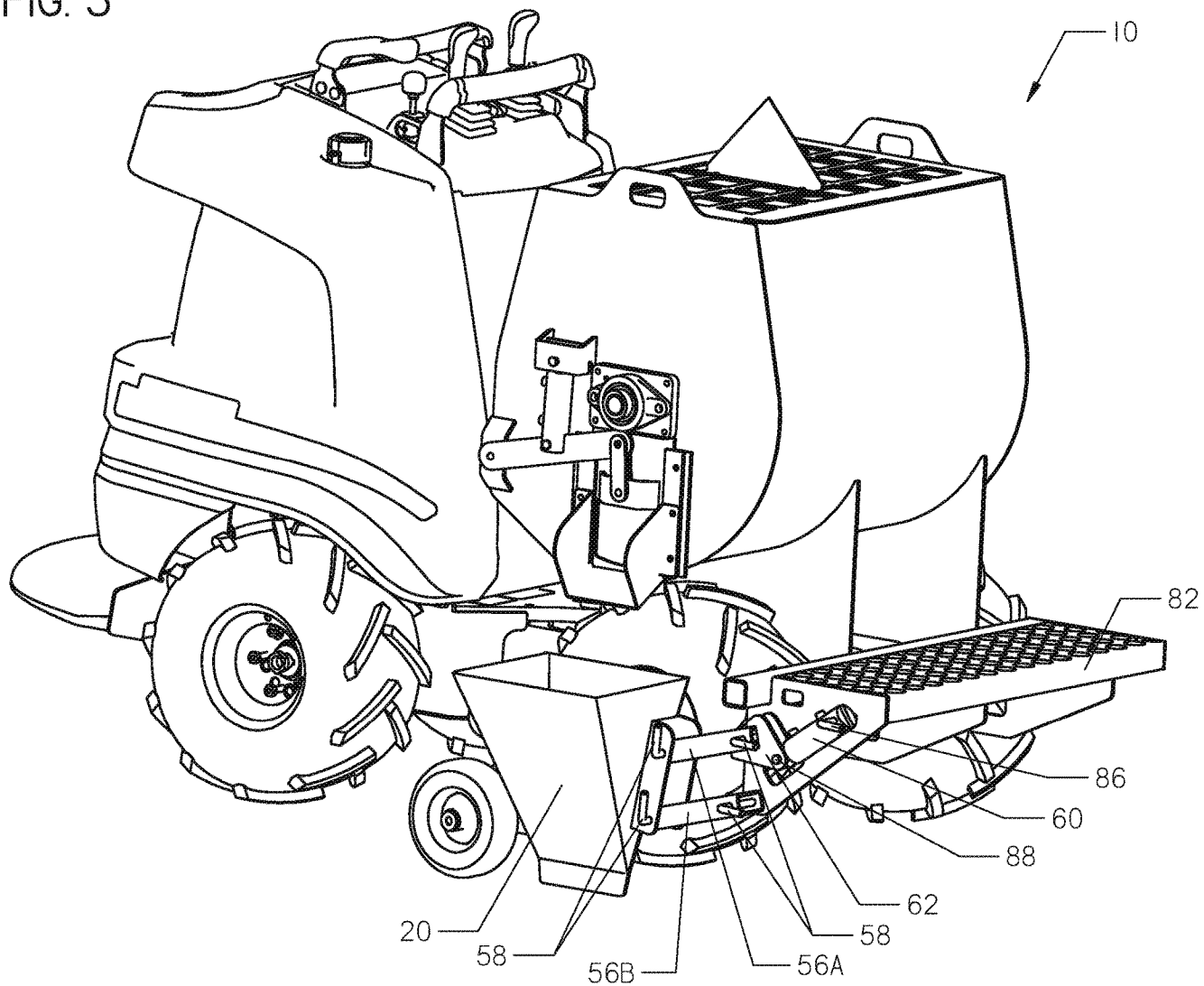
FIG. 3 is a perspective front view of the trench filling machine.

Turning now to FIG. 3, a side view of the machine 10 is shown with the side plate 64 (FIG. 2) removed exposing the cylinder 60 and lever 62. The cylinder 60 is pivotally connected to the side of the platform 82 via a fastener 86. The opposite end of the cylinder 60 is pivotally connected to the lever 62 via a fastener 88. Contained within the cylinder 60 is a piston (not shown) which may be extended and retracted, in turn pushing and pulling on the lever 62.

The forces exerted on the lever 62 by the piston and cylinder 60 work to manipulate the lift arms 56A and 56B up and down through movement of the lever 62. The lever 62 is pivotally attached to lift arm 56A using fasteners 58 and lift arm 56B is also pivotally attached to the side of the platform 82 using fasteners 58. Movement of the lift arms 56A and 56B up and down works to move the hopper 20 in and out of the trench.

Figure 4:
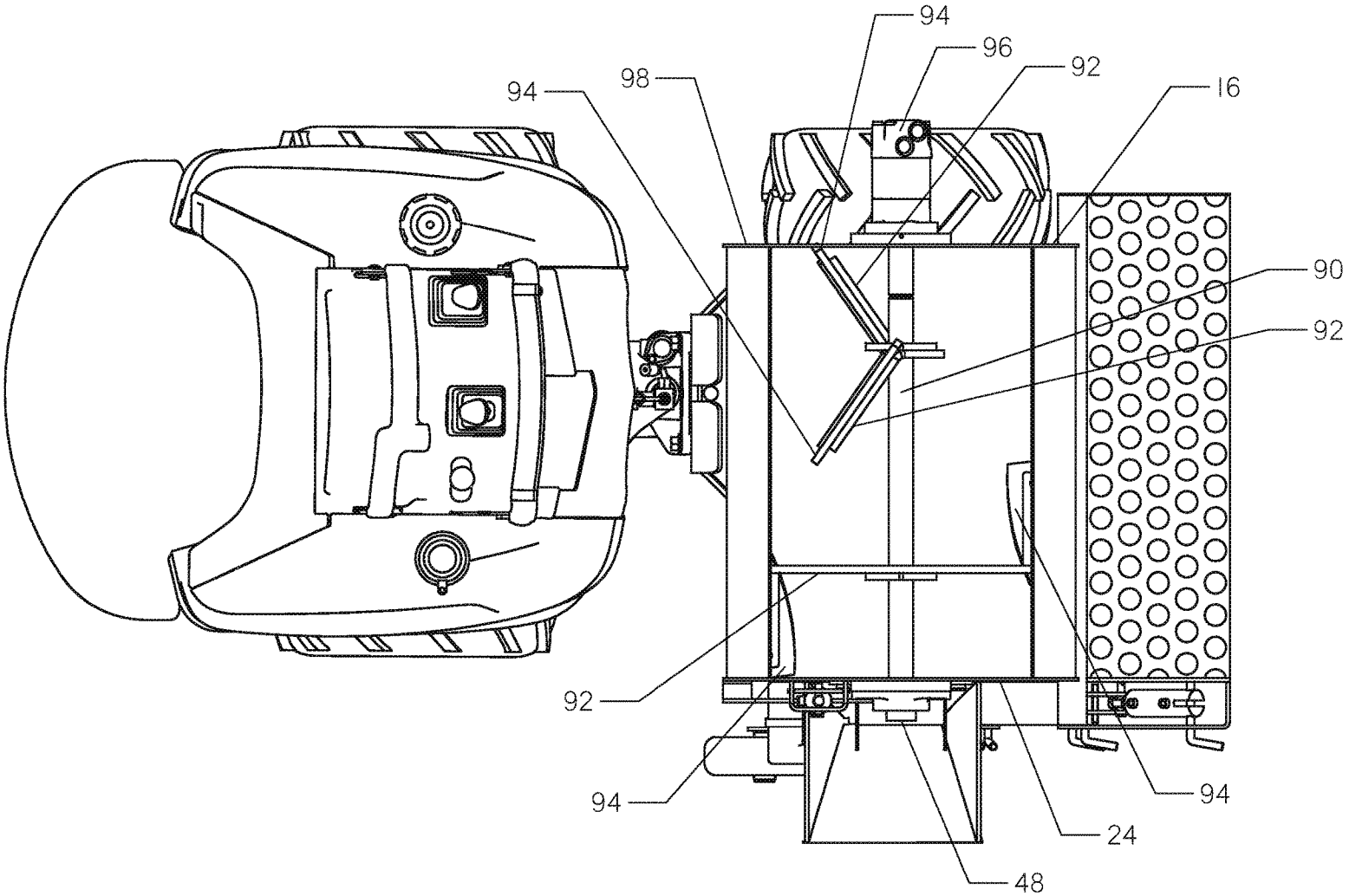
FIG. 4 is a top view of the trench filling machine.

Turning now to FIG. 4, a top view of the trench filling machine is shown with the top grate 78 (FIG. 2) of the tub 16 removed exposing the interior of the tub. The shaft 90 runs lengthwise through the center of the tub 16. Attached to the shaft 90 are blades 92 which work to stir the material inside the tub 16. Attached to the blades 92 are rubber paddles 94 which work to scrape material from the insides of the tub 16 while the blades 92 are stirring the mixture.

A motor 96 is attached to a second side 98 of the tub 16. The motor 96 connects to the shaft 90 inside the tub 16 and spins the shaft 90 which in turn spins the blades 92 and paddles 94. The shaft 90 is connected on its opposite side to the bearing 48 located on the first side 24 of the tub 16. The motor 96 continually spins the shaft 90 throughout the trench filling process to mix the material and move it toward door 34 (FIG. 1).

Figure 5:
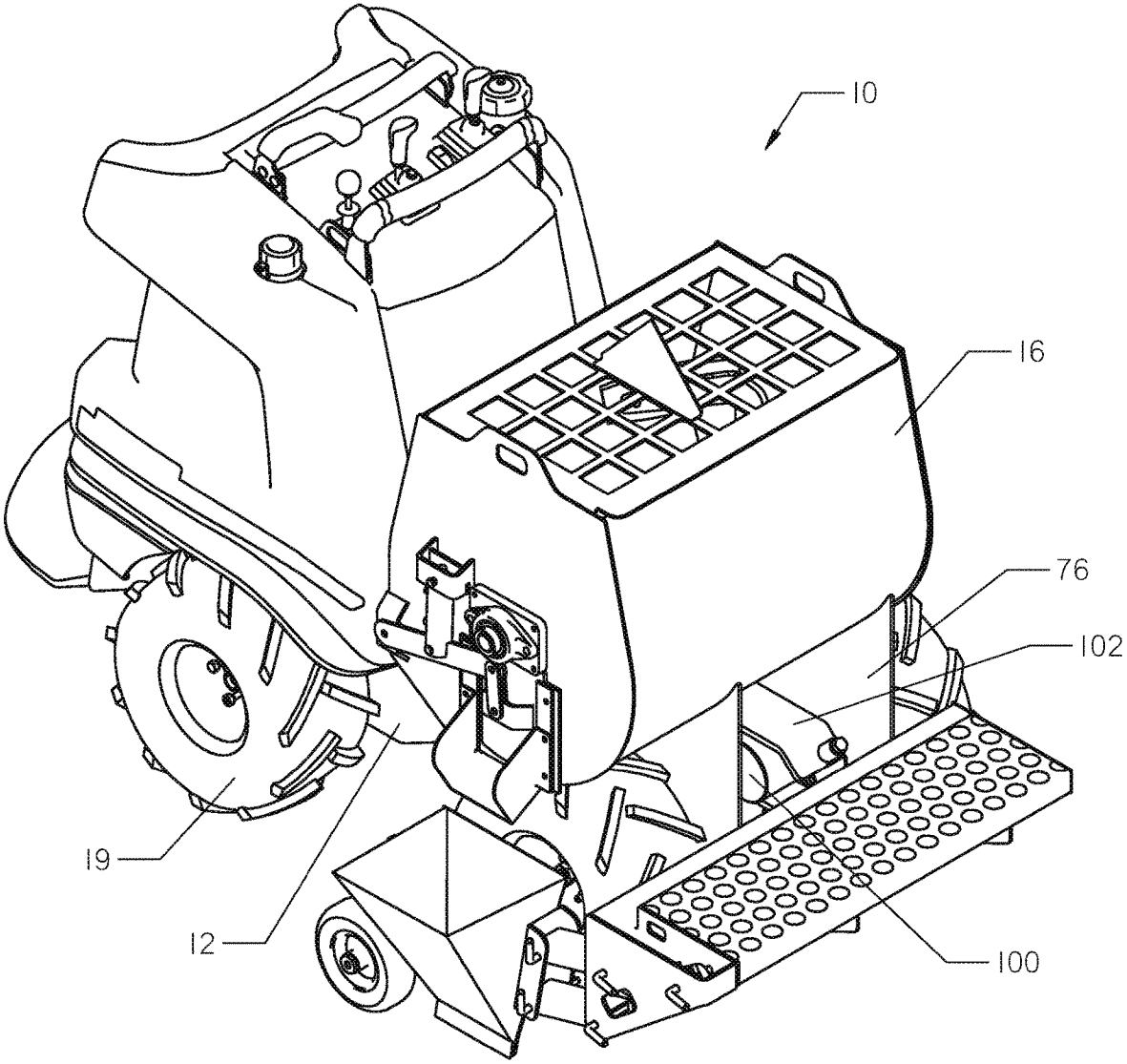
FIG. 5 is perspective front view of the trench filling machine.

Turning finally to FIG. 5, a front perspective view of the trench filling machine 10 is shown. A hydraulic motor 100 is shown beneath brace 76. The hydraulic motor 100 works to power the motive means 19 on the frame 12 in operation. An attachment plate 102 is also shown which connects the tub 16 to the frame 12.

Figure 6:
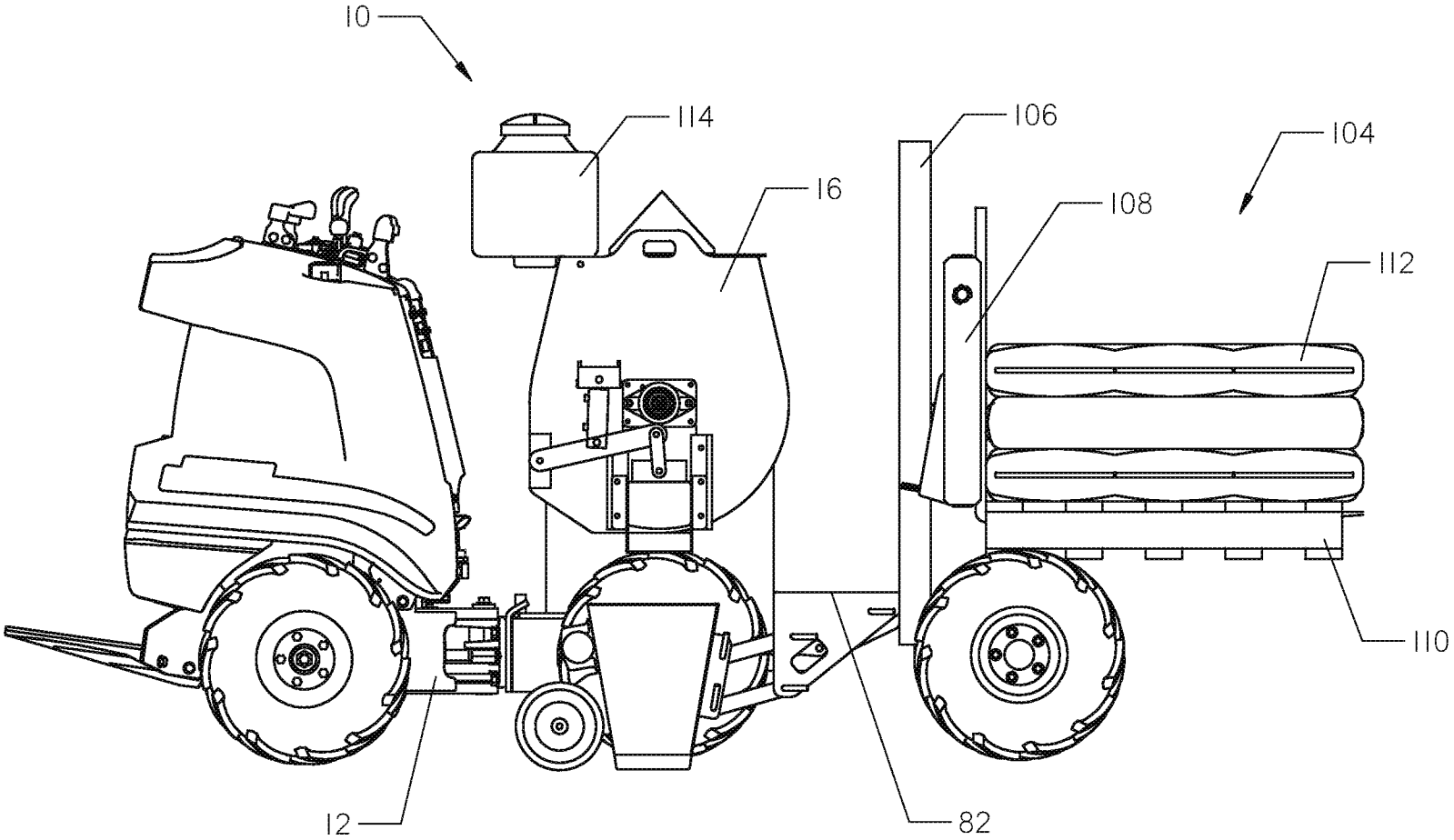
FIG. 6 is a side view of the trench filling machine having a carriage assembly.

Referring now to FIG. 6, a side view of an alternative embodiment of the trench filling machine 10 is shown with additional features. Attached to the front of the machine 10 is a carriage assembly 104. The carriage assembly 104 comprises a support 106, a hydraulic forklift 108, and a pallet 110. The support 106 is attached to the platform 82. The hydraulic forklift 108 is attached to the support 106 and is capable of moving up and down carrying a plurality of bags of material 112. The bags of material 112 rest on pallet 110 which slides on the forks (not shown) of hydraulic lift 108. Also, shown in FIG. 6 is a container 114 connected to the top of the tub 16 for holding water or other liquids used to mix with the material. Transporting liquids and additional bags of material with the machine 10 as it moves makes it more convenient to mix additional material. Material can be mixed right at the machine 10 rather than having to transport the machine 10 back to where additional mixing materials are located.

In operation, material is poured into the tub 16 with a mixing solution, such as water, and mixed together via the blades 92 spinning on the shaft 90. The trench filling machine 10 is positioned parallel to the trench to be filled. The hopper 20 is placed over the open trench such that the hopper 20 may be positioned within the trench at a desired depth allowing the wheel 68 to rest on the ground parallel to the trench.

The hopper 20 is moved via the lift arms 56A and 56B and cylinder 60 as shown in FIG. 3. When the cylinder 60 extends the piston (not shown) which pushes against lever 62, the lift arm 56A is forced upward moving lift arm 56B upward and moving the hopper 20 closer to the spout 40. When the piston is fully retracted inside the cylinder 60, the lift arms 56 are forced down moving the hopper 20 into the open trench. FIG. 3 shows the hopper 20 in the lowered position.

Once the hopper 20 is positioned in the trench as desired, the release assembly 18 can begin to release material into the hopper 20. The door 34 is in the closed position sealing off any material from exiting the tub 16 when the piston (not shown) within the cylinder 30 is extended. The piston extends from cylinder mount 32 from which it is connected. To open the door 34 the piston retracts into the cylinder 30 pulling the horizontal link 28 upwards which in turn pulls the door 34 upwards. Once the door 34 begins to open, the material is free to flow out of the door 34, down the spout 40, and into the hopper 20. When the hopper 20 is filled to the desired amount, the piston is extended from the cylinder 30 pushing the horizontal link 28 downwards and in turn pushing the door 34 downwards until it is closed.

Upon pouring the material into the hopper 20, the material begins to flow downward and pass out the discharge conduit 21 of the hopper 20 and into the trench. The vibrator 70 vigorously vibrates the hopper 20 to prevent material from clogging the conduit of the hopper 20 or from being stuck to the sides of the hopper 20. The vibrator 70 also helps to increase the rate of flow of the material from the hopper 20 into the trench to be filled.

The trench filling machine 10 is driven alongside the trench via the operator station 14 and the motive means 19. The material flows from the hopper 20 in the trench as the machine 10 moves. The trench filling machine 10 allows the operator to place materials in the trenches by operating the controls 22 at the operator station 14. Keeping the material in the hopper 20 separate from the material contained in the tub 16, allows the operator to take a break once the hopper 20 has been emptied without worry of the material within the tub 16 hardening.

Figure 7:
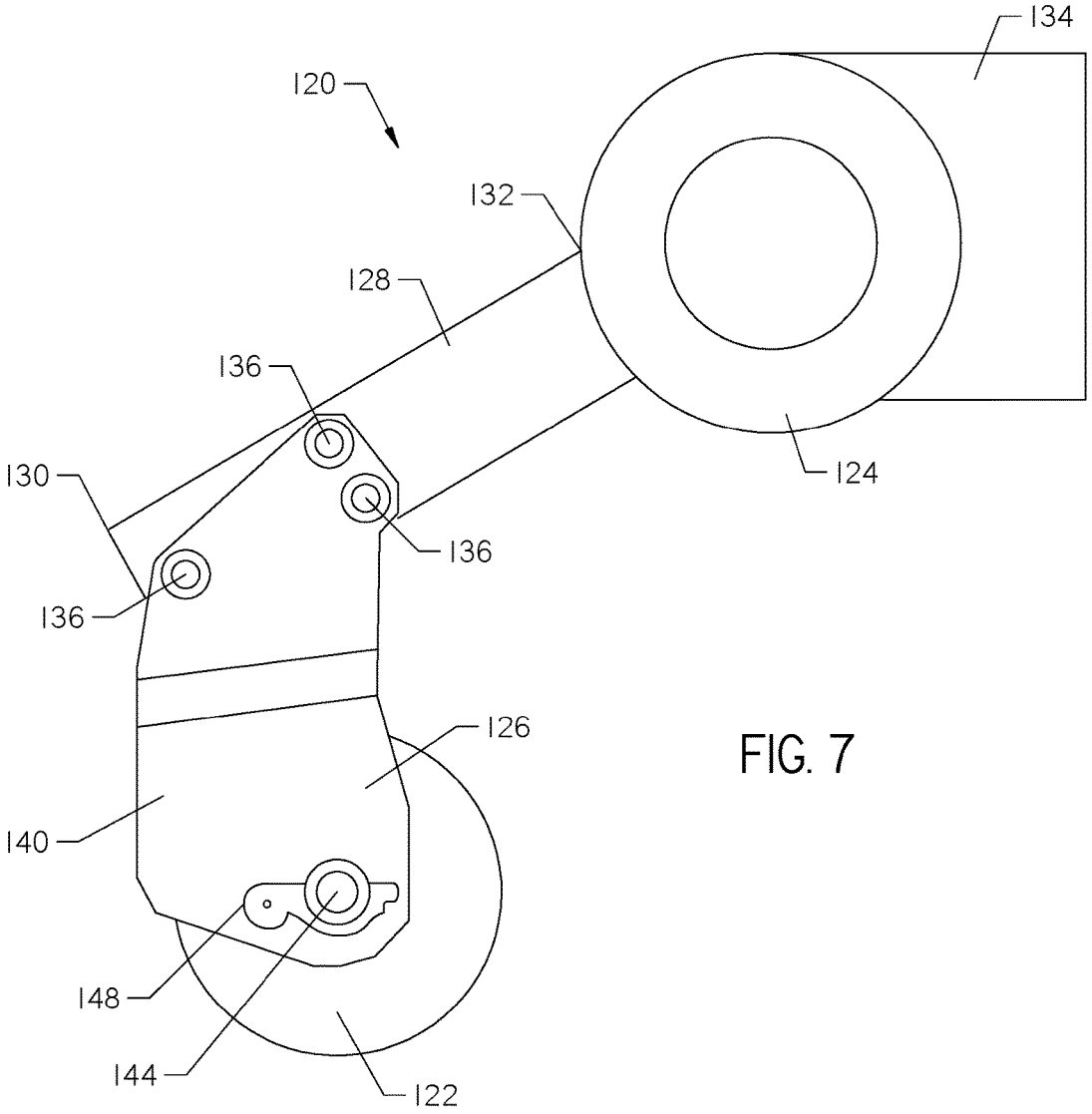
FIG. 7 is a side view of a compactor assembly that may be attached to the hopper of the trench filling machine of FIG. 1.
Figure 8:
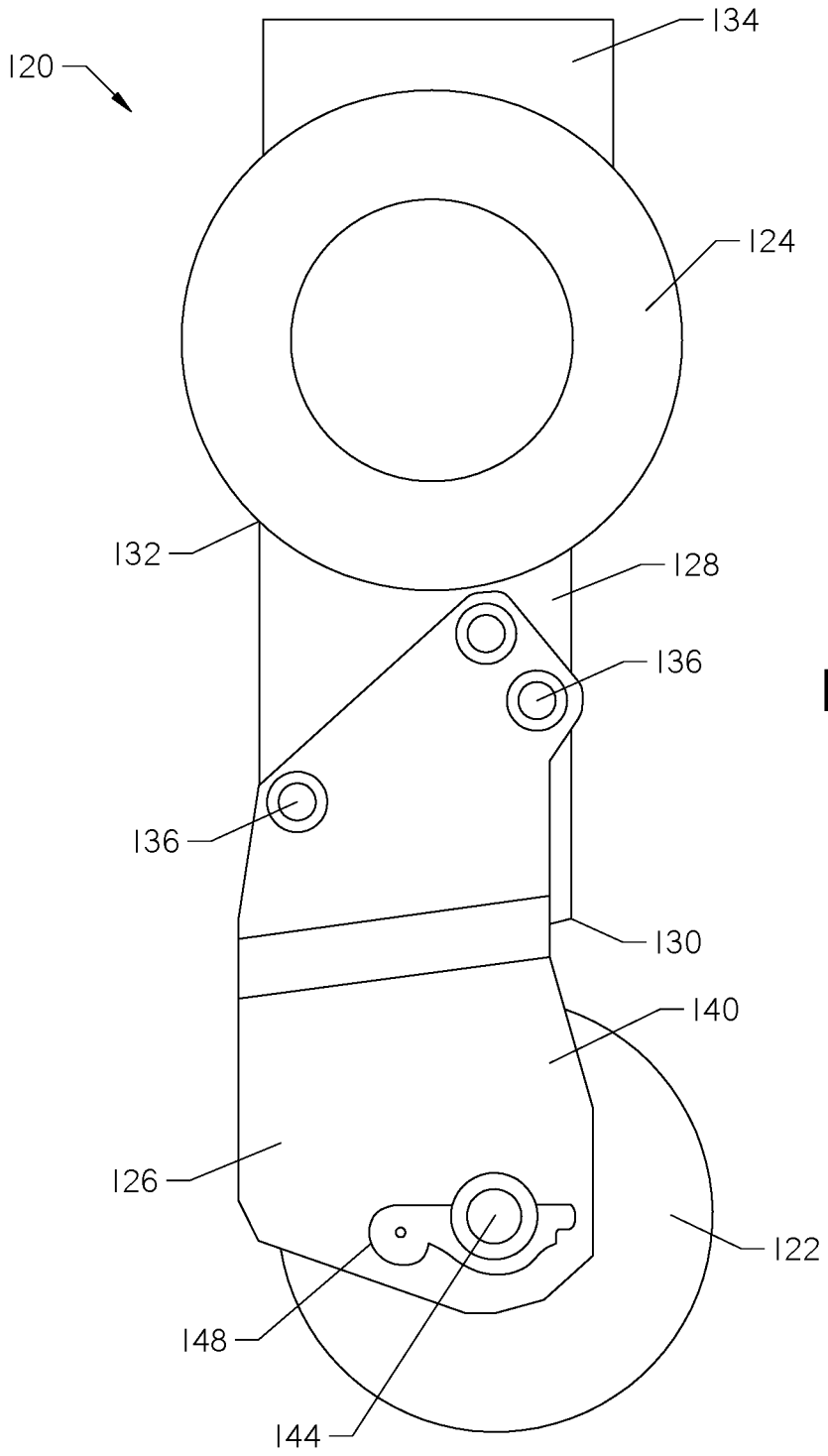
FIG. 8 is a side view of an alternative embodiment of the compactor assembly of FIG. 7.
Figure 9:
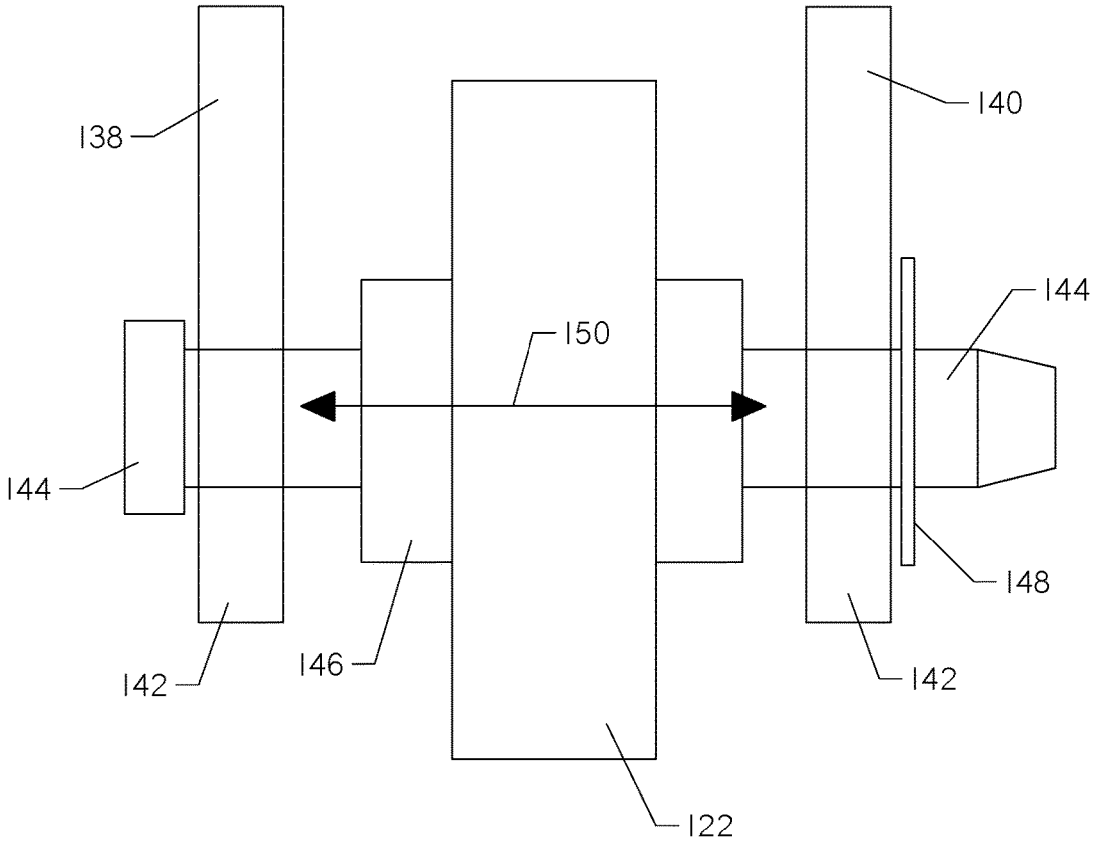
FIG. 9 is a straight on view of a compact wheel of the compactor assembly in FIGS. 7-8. The compact wheel is shown supported on a wheel mount.

Turning now to FIGS. 7-9, a compactor assembly 120 is shown. The compactor assembly 120 may be used in place of or in conjunction with the small wheel 68 (FIG. 1). The compactor assembly 120 follows immediately behind the hopper 20 and packs the material into the trench. The compactor assembly 120 comprises a compact wheel 122 and a vibrator motor 124. The compact wheel 122 pushes down on the material deposited into the trench by the hopper 20 in order to compact the material into the trench. The vibrator motor 124 vibrates the compact wheel 122 so as to cause the wheel to move in a percussive fashion. The rapid percussive movement of the compact wheel 122 on the material helps to pack the material into the trench.

As shown in FIGS. 7-8, the compact wheel 122 is supported on a wheel mount 126. The wheel mount 126 is attached to the vibrator motor 124 via an arm 128. The wheel mount 126 is attached to a first end 130 of the arm 128 and the vibrator motor 124 is attached to a second end 132 of the arm 128. A bracket 134 is attached to the vibrator motor 124 opposite the arm 128. The bracket 134 attaches the compactor assembly 120 to the hopper 20. The compactor assembly 120 is attached to the hopper 20 such that the compact wheel 122 follows directly behind the discharge conduit 21. The compactor assembly 120 will move up and down with the hopper 20. This is because the compactor assembly 120 is attached to the hopper 20.

The arm 128 may vary in size depending on the size of the hopper 20. If the compact assembly 120 is attached to a larger hopper 20, a longer arm 128 may be required to properly position the compact wheel 122 behind the discharge conduit 21. For example, the arm 128 shown in FIG. 7 is longer than the arm 128 shown in FIG. 8. The arm 128 is attached to the wheel mount 126 via a plurality of fasteners 136. The wheel mount 126 may be attached at different angles to the arm 128 to further properly position the compact wheel 122 behind the discharge conduit 21 of the hopper 20.

Turning now to FIG. 9, the wheel mount 126 is shown in more detail. The wheel mount 126 comprises a first side plate 138 and a second side plate 140. The first and second side plates 138, 140 are attached to opposite sides of the arm 128 via the fasteners 136 (FIGS. 7-8). The side plates 138, 140 each have an opening proximate their bottom end 142 for receiving a pin 144. The compact wheel 122 has a rim 146 formed in its center. The rim 146 may be wider than the wheel 122, as shown in FIG. 9. The rim 146 has an opening for receiving the pin 144.

The pin 144 is disposed through the opening in the first side plate 138, the rim 146, and the second side plate 140. The wheel 122 is supported on the pin 144 and held between the first side plate 138 and the second side plate 140. A locking pin 148, also shown in FIGS. 7-8, is attached to the pin 144 after the pin passes through the second side plate 140. The locking pin 148 holds the pin 144 in place and prevents lateral movement of the pin 144 through the openings formed in the side plates 138, 140 and the rim 146.

The distance between the side plates 138, 140 is greater than the width of the compact wheel 122. Due to this, a space is created between each side plate 138, 140 and the wheel 122. The space allows the compact wheel 122 to move laterally about the pin 144, as shown by arrow 150. This allows the wheel 122 to follow slight variations in the trench as it compacts the material. The outer circumference of the compact wheel 12 may have a convex or concave shape. These shapes may help to more effectively pack the material into the trench.

Although the present invention has been described with respect to preferred embodiment, various changes and modifications may be suggested to one skilled in the art, and it is intended that the present invention encompass such changes and modifications as fall within the scope of this disclosure.

What is claimed is:

1. A trench filling machine, comprising:
- a frame;
- a plurality of ground-contacting motive elements for moving the frame on a ground surface along a path;
- a mixing vessel supported by the frame;
- a hopper supported by the frame and having a discharge conduit, in which the hopper is laterally offset from the path of the frame;
- a compactor assembly attached to the hopper;
- a release assembly configured to move material from the mixing vessel to the hopper; and
- a positioning system configured to selectively move the discharge conduit above and below the ground surface.

2. The trench filling machine of claim 1 wherein the compactor assembly comprises a compact wheel and a vibrator motor.

3. The trench filling machine of claim 2 wherein the compact wheel is supported on a wheel mount comprising:
- a first side plate;
- a second side plate; and
- a pin disposed through an opening in the first side plate, the compact wheel, and the second side plate;
- wherein the wheel is supported on the pin between the first side plate and the second side plate.

4. The trench filling machine of claim 3 wherein the wheel can move laterally about the pin.

5. The trench filling machine of claim 2 wherein the compactor assembly is attached to the hopper such that the compact wheel follows directly behind the discharge conduit as the hopper deposits material into the trench.

6. The trench filling machine of claim 1 in which the compactor assembly comprises one and only one compact wheel.

7. The trench filling machine of claim 6 in which the one and only one compact wheel has a flat ground-engaging surface.

8. The trench filling machine of claim 7 in which the ground-engaging surface of the one and only one compact wheel is sized to be closely received within a narrow trench.

9. The trench filling machine of claim 6 in which the one and only one compact wheel has a ground-engaging surface, and in which the positioning system is configured to selectively move the discharge conduit above and below the lowermost level of the ground-engaging surface of the one and only one compact wheel.

10. The trench filling machine of claim 1 further comprising a ground-engageable guide wheel supported on the hopper.

11. The trench filling machine of claim 10 in which the positioning system is configured to selectively move the discharge conduit above and below the lowermost level of the ground-engageable guide wheel.

12. The trench filling machine of claim 1 in which the hopper is positioned between a front edge and a rear edge of the machine.

13. The trench filling machine of claim 1 in which the hopper is vertically aligned with the mixing vessel.

14. The trench filling machine of claim 1 further comprising:

an operator station supported on the frame and having controls for the machine, in which the hopper is positioned in front of the operator station with respect to forward movement of the frame.

15. The trench filling machine of claim 14 in which the mixing vessel is positioned ahead of the operator station with respect to forward movement of the frame.

16. The trench filling machine of claim 1 in which the release assembly comprises:

a door configured to move up and down on a side wall of the mixing vessel.

17. The trench filling machine of claim 1, further comprising:

a rotatable shaft disposed within the mixing vessel;

a blade attached to the rotatable shaft; and a paddle attached to the blade and configured to scrape a material from the mixing vessel when the shaft is rotated.

18. The trench filling machine of claim 1 in which the positioning system comprises:

a lift arm connected to the frame and the hopper.

19. The trench filling machine of claim 1 further comprising:

a vibrator supported by the hopper.

20. A system, comprising:

a ground surface having a narrow trench;

the trench filling machine of claim 1 positioned adjacent the trench and the discharge conduit of the hopper at least partially disposed within the trench.

* * * * *